US009920756B2

(12) United States Patent
Merk

(10) Patent No.: US 9,920,756 B2
(45) Date of Patent: Mar. 20, 2018

(54) ROTARY PUMP WITH A PLASTIC COMPOSITE STRUCTURE

(71) Applicant: Schwäbische Hüttenwerke Automotive GmbH, Aalen-Wasseralfingen (DE)

(72) Inventor: Klaus Merk, Bad Wurzach (DE)

(73) Assignee: Schwäbische Hüttenwerke Automotive GmbH, Aalen-Wasseralfingen (DE)

( * ) Notice: Subject to any disclaimer, the term of this patent is extended or adjusted under 35 U.S.C. 154(b) by 293 days.

(21) Appl. No.: 14/622,996

(22) Filed: Feb. 16, 2015

(65) Prior Publication Data

US 2015/0240806 A1 Aug. 27, 2015

(30) Foreign Application Priority Data

Feb. 27, 2014 (DE) ..... 10 2014 102 643

(51) Int. Cl.
*F01C 5/02* (2006.01)
*F01C 20/18* (2006.01)
(Continued)

(52) U.S. Cl.
CPC ..... *F04C 2/34* (2013.01); *F04C 2/344* (2013.01); *F04C 14/18* (2013.01); *F04C 14/226* (2013.01);
(Continued)

(58) Field of Classification Search
CPC ..... F04C 2/34; F04C 2/344; F05C 2225/00
(Continued)

(56) References Cited

U.S. PATENT DOCUMENTS 4,028,021 A * 6/1977 Berkowitz ..... F01C 1/22 418/129
6,821,099 B2 * 11/2004 Wilk ..... F04C 2/3446 418/15
(Continued)

FOREIGN PATENT DOCUMENTS

CN 2284870 6/1998
CN 2420360 Y 2/2001
(Continued)

OTHER PUBLICATIONS

Extended European Search Report dated Jun. 1, 2015 for European Application No. 15156205.5, including partial English translation, 7 pages.
(Continued)

*Primary Examiner* — Mark Laurenzi
*Assistant Examiner* — Deming Wan
(74) *Attorney, Agent, or Firm* — RatnerPrestia

(57) ABSTRACT

A rotary pump including: a housing having an inlet and an outlet for a fluid, and a delivery chamber connected to the inlet and outlet; a delivery rotor rotatable in the delivery chamber about a rotational axis has a structure which is central in relation to the rotational axis; and a setting structure surrounding the delivery rotor and with the delivery rotor forms delivery cells, delivering the fluid from the inlet to the outlet, can be moved back and forth relative to the delivery rotor, in order to adjust a delivery volume of the rotary pump. At least one of the setting structure and/or the rotor structure is a material composite structure including a molded region made of plastic and a functional region which is fixedly connected to the molded region and made of a functional material which has a different chemical composition to the plastic of the molded region.

20 Claims, 10 Drawing Sheets

(51) Int. Cl.

| | |
|---|---|
| ***F04C 14/18*** | (2006.01) |
| ***F04C 2/34*** | (2006.01) |
| ***F04C 15/06*** | (2006.01) |
| ***F04C 18/34*** | (2006.01) |
| ***F04C 28/18*** | (2006.01) |
| ***F04C 29/12*** | (2006.01) |
| ***F04C 2/344*** | (2006.01) |
| ***F04C 14/22*** | (2006.01) |

(52) U.S. Cl.
CPC ..... *F04C 15/06* (2013.01); *F04C 18/34* (2013.01); *F04C 28/18* (2013.01); *F04C 29/12* (2013.01); *F04C 2230/21* (2013.01); *F04C 2240/10* (2013.01); *F04C 2240/20* (2013.01)

(58) Field of Classification Search
USPC ..... 418/152–154, 24, 30, 26, 31, 178, 179
See application file for complete search history.

(56) References Cited

U.S. PATENT DOCUMENTS

| | | | | |
|---|---|---|---|---|
| 7,736,134 | B2 * | 6/2010 | Schneider | F04C 2/3445 417/220 |
| 8,246,332 | B2 | 8/2012 | Cadeddu et al. | |
| 2004/0219036 | A1 | 11/2004 | Lang | |
| 2007/0148011 | A1 | 6/2007 | Schulz-Andres | |
| 2009/0053088 | A1 * | 2/2009 | Shulver | F01C 21/0836 418/16 |
| 2009/0209179 | A1 * | 8/2009 | Hutchins | B24B 23/026 451/163 |
| 2014/0050562 | A1 | 2/2014 | Welte | |

FOREIGN PATENT DOCUMENTS

| | | | |
|---|---|---|---|
| CN | 100408858 | | 8/2008 |
| CN | 201148018 | Y | 11/2008 |
| CN | 103591020 | | 2/2014 |
| DE | 10 2008 036 273 | B4 | 2/2010 |
| DE | 10 2011 014 591 | A1 | 9/2012 |
| DE | 102011014591 | | 9/2012 |
| DE | 10 2011 086 175 | B3 | 5/2013 |
| EP | 2 735 740 | A1 | 5/2014 |
| JP | H06051589 | | 7/1994 |
| JP | 2005325784 | | 11/2005 |
| KR | 102010020686 | | 2/2010 |
| WO | 2004109110 | | 12/2004 |

OTHER PUBLICATIONS

Chinese Office Action dated Sep. 19, 2016 for Chinese Application No. 201510090063.5, including English translation, 25 pages.
Japanese Office Action dated Apr. 15, 2016 for Japanese Application No. 2015-27773, including English translation, 13 pages.
German Office Action issued in DE 10 2014 102 643.8 dated Jul. 28, 2014.
European Communication for European Application No. 15 156 205.5, dated Sep. 19, 2017, including English translation, 8 pages.
German Office Action issued in German Patent Application DE 10 2014 102 643.8, dated Jul. 27, 2017, 4 pages.
Chinese Second Office Action issued in Chinese Patent Application CN 201510090063.5, dated Jun. 1, 2017, 29 pages.

* cited by examiner

11

ROTARY PUMP WITH A PLASTIC COMPOSITE STRUCTURE

CROSS REFERENCE TO RELATED APPLICATIONS

This application claims priority to German Patent Application No. DE 102014102643.8, filed Feb. 27, 2014, the contents of such application being incorporated by reference herein.

FIELD OF THE INVENTION

The invention relates to a rotary pump comprising at least one pump component which consists entirely or only in regions of plastic. The invention can advantageously be realised both in a rotary pump for an incompressible fluid, i.e. a displacement pump, and in a rotary pump for a compressible fluid, i.e. a gas pump such as in particular a vacuum pump. The rotary pump can be adjusted, preferably regulated, in terms of its specific delivery volume, i.e. in terms of the delivery volume per revolution of a delivery rotor. The pump can for example be an internal toothed ring pump or a reciprocating piston valve pump; preferably, however, the pump is a single-vane or multi-vane vane pump.

BACKGROUND OF THE INVENTION

In vehicle manufacturing, in particular automobile manufacturing which is a preferred area of application for the invention, there is a constant endeavour to reduce the weight and in particular also the cost of vehicle components. The high demands made with respect to for example mechanical strength, wear resistance and fatigue strength must nonetheless be met. Due to the high numbers of units involved in mass production and the associated economies of scale, even minimal reductions in unit cost achieve significant cost savings when considered over the production run.

SUMMARY OF THE INVENTION

An aspect of the invention reduces the manufacturing costs of a rotary pump but still meet the technical demands made on the rotary pump.

An aspect of the invention proceeds from a rotary pump, preferably a vane pump, comprising: a housing which comprises an inlet and an outlet for a fluid to be delivered and comprises a delivery chamber which is connected to the inlet and the outlet; a delivery rotor which can be rotated in the delivery chamber about a rotational axis; and a setting structure which surrounds the delivery rotor. The delivery chamber can be bounded and therefore defined just by the housing and setting structure alone. It is however conceivable in principle for the delivery chamber to also (and only then) be delimited by means of another structure or as applicable also multiple other structures. The delivery rotor and the setting structure form delivery cells in which the fluid can be delivered from the inlet to the outlet by rotating the delivery rotor, in that the delivery cells increase in size on a low-pressure side of the delivery chamber and decrease again in size on a high-pressure side of the delivery chamber, as is known from internal toothed ring pumps and reciprocating piston valve pumps and in particular vane pumps. In order to be able to adjust the specific delivery volume, the setting structure can be moved back and forth relative to the delivery rotor, preferably transverse to the rotational axis of the delivery rotor. The setting structure can be arranged in the housing such that it can in particular be pivoted or linearly moved, in order to be able to adjust the specific delivery volume.

The delivery rotor comprises a rotor structure. The rotor structure can itself form the delivery rotor, which would consist of one part in such embodiments. The delivery rotor in internal toothed ring pumps, for example, is formed in one part. It is also conceivable in principle for a vane pump to comprise a delivery rotor which consists of one part, such that the terms "delivery rotor" and "rotor structure" can refer to the same part. A delivery rotor which is formed as a vane wheel which consists of one part can for example comprise elastically flexible vanes which yield material-elastically in order to be able to form the delivery cells which increase in size and decrease again in size. More preferably, however, a delivery rotor formed as a vane wheel consists of multiple parts and comprises the rotor structure, which is central in such embodiments, and one or more vanes which project outwards from the rotor structure and can (each) be moved, preferably slid, in its/their entirety relative to the rotor structure. Examples of single-vane and multi-vane rotary pumps are to be found in DE 10 2011 086 175 B3 and DE 10 2008 036 273 B4, each incorporated by reference herein.

In accordance with an aspect of the invention, the setting structure and/or the rotor structure is/are a material composite structure. The respective material composite structure comprises a moulded region made of plastic and a functional region which is fixedly and immovably connected to the moulded region and made of a functional material which has a different chemical composition to the plastic of the moulded region. The at least two different materials can also differ from each other in other respects, for example in terms of their density or in terms of added substances such as for example embedded reinforcing fibres or other reinforcing or functional bodies which, if present, are dispersed at least substantially homogenously in the respective material in large numbers. The functional material can in particular be a metallic material such as for example a light metal or a light-metal alloy or preferably a steel. The metallic functional material can in particular be a cast body or sintered body which correspondingly exhibits a cast structure or sintered structure. Instead, however, the functional material can also likewise be a plastic.

In preferred embodiments, the moulded region is larger than the functional region in terms of its volume and/or mass. The functional region is expediently a region in which the material composite structure is subject to a particular stress, such as for example dynamic friction, or is otherwise exposed to wear. In the case of such a function, a sliding material is correspondingly selected as the functional material. Instead of or in combination with its good sliding properties, however, the functional material can also be selected with a view to increasing the rigidity of the material composite structure or improving another property of the material composite structure.

The material composite structure can in particular consist of a single continuous moulded region and a single continuous functional region. It can however also comprise multiple functional regions made of either the same functional material in each case or of different functional materials. It can also comprise two or more moulded regions made of the same plastic, wherein the multiple moulded regions are not continuous but rather separated from each other, in particular by the functional region or by one of multiple functional regions.

The moulded region and the functional region can be manufactured in a joint method of original moulding, such as for example injection moulding, for example by co-injection, if the functional material is likewise a plastic. If the material composite structure is composed of a moulded region and multiple functional regions or comprises multiple moulded regions which are separated from each other, the same applies to the more than two structural regions in such variants.

In preferred embodiments, however, the functional region or optionally the multiple functional regions is/are manufactured separately from the moulded region or optionally the multiple moulded regions and permanently and fixedly connected, preferably in a positive fit, to the moulded region or as applicable the multiple moulded regions, as the moulded region or regions is/are moulded. The plastic of the moulded region can then be entirely or at least partially injected around a functional region, in particular as the moulded region is being manufactured. The moulded region and the functional region can be connected to each other in a frictional fit and/or material fit and/or positive fit. In preferred embodiments, the connection includes at least a positive fit. The different regions can in principle be manufactured separately from each other and connected to each other by means of a join connection; more preferably, however, a fixed connection is established in a method of originally moulding the moulded region, as already mentioned, by placing the functional region—produced beforehand—into a die, such as for example a plastic injection-moulding die, and moulding—preferably, injecting—the plastic of the moulded region entirely or at least partially around it.

In the interests of making cost savings, the plastic used as the plastic of the moulded region is preferably one which is cheaper per unit mass and/or unit volume than the functional material.

Features of the invention are also described in the aspects formulated below. The aspects are worded in the manner of claims and can be substituted for them. Features disclosed in the aspects can also supplement and/or qualify the claims, indicate alternatives to individual features and/or broaden features of claims. Bracketed reference signs refer to an example embodiment which is illustrated in figures below. They do not restrict the features described in the aspects to their literal sense as such, but do conversely indicate preferred ways of realising the respective feature.

Aspect 1. A rotary pump, preferably a vane pump, comprising:

(a) a housing (1) which comprises an inlet (3) and an outlet (4) for a fluid and comprises a delivery chamber (2) which is connected to the inlet and the outlet;

(b) a delivery rotor (10) which can be rotated in the delivery chamber (2) about a rotational axis ($R_{10}$) and comprises a rotor structure (11) which is central in relation to the rotational axis ($R_{10}$);

(c) and a setting structure (20) which surrounds the delivery rotor (10) and together with the delivery rotor (10) forms delivery cells (9), in order to deliver the fluid from the inlet (3) to the outlet (4), and can be moved back and forth relative to the delivery rotor (10), preferably transverse to the rotational axis ($R_{10}$), in order to be able to adjust a specific delivery volume of the rotary pump;

(d) wherein at least one of the structures (11, 20), i.e. the setting structure (20) and/or the rotor structure (11), is a material composite structure and comprises a moulded region (15; 25) made of plastic and a functional region (16; 26) which is fixedly connected to the moulded region (15; 25) and made of a functional material which has a different chemical composition to the plastic of the moulded region (15; 25).

Aspect 2. The rotary pump according to Aspect 1, wherein the functional region (16; 26) reinforces and/or rigidifies the material composite structure (11; 20) and/or forms a sliding surface (17; 27) and/or a bearing or joining region (19) of the material composite structure (11; 20).

Aspect 3. The rotary pump according to any one of the preceding aspects, wherein the functional region (16; 26) is manufactured separately from the moulded region (15; 25), and the moulded region (15; 25) is moulded on or around the functional region (16; 26) in a method of original moulding, preferably injection moulding, whereby the regions (15, 16; 25, 26) are fixedly connected to each other.

Aspect 4. The rotary pump according to any one of the preceding aspects, wherein the functional region (16; 26) is connected to the moulded region (15; 25) in a positive fit and/or frictional fit and/or material fit.

Aspect 5. The rotary pump according to any one of the preceding aspects, wherein the functional region (16; 26) is entirely or partially embedded in the moulded region (15; 25), and the functional region (16; 26) rigidifies and/or reinforces the moulded region (15; 25) or the moulded region (15; 25) rigidifies and/or reinforces the functional region (16; 26).

Aspect 6. The rotary pump according to any one of the preceding aspects, wherein the functional region (16; 26) rigidifies and/or reinforces the moulded region (15; 25) in order to improve the dimensional stability of the rigidified and/or reinforced moulded region during pump operations.

Aspect 7. The rotary pump according to any one of the preceding aspects, wherein the functional region (26; 31) forms and/or surrounds, circumferentially about the rotational axis ($R_{10}$), an inner circumferential surface (27) of the setting structure (20) which surrounds the delivery rotor (10).

Aspect 8. The rotary pump according to any one of the preceding aspects, wherein the functional region (16; 26) and the moulded region (15; 25) are connected to each other in a positive fit, in that one of these regions protrudes into the other at one or more points (18; 28; 29; 30).

Aspect 9. The rotary pump according to any one of the preceding aspects, wherein the functional region (16; 26) and the moulded region (15; 25) are anchored to each other, in that one of these regions grips behind the other at one or more points (18; 30).

Aspect 10. The rotary pump according to any one of the preceding aspects, wherein at least one of the regions, preferably the functional region (16; 26), comprises one or more recesses (18; 28; 30), preferably one or more passages (30), into which material of the other region can protrude and/or which is/are penetrated by the material of the other region.

Aspect 11. The rotary pump according to the preceding aspect, wherein the material of the other region has penetrated into the recess(es) and/or through the passages in a fluid form as the material composite structure (11; 20) is moulded.

Aspect 12. The rotary pump according to any one of the preceding aspects, wherein the functional region (16; 26) forms an inner region of the material composite structure (11; 20), and the moulded region (15; 25) surrounds the functional region (16; 26) on the outside over a portion of its circumference or over its entire circumference.

Aspect 13. The rotary pump according to any one of the preceding aspects, wherein the functional material is a sliding material and forms a sliding surface (17; 27) of the material composite structure (11; 20).

Aspect 14. The rotary pump according to the preceding aspect, wherein the functional material on the sliding surface (17; 27) exhibits a coefficient of friction which is lower than the plastic of the moulded region (15; 25) in relation to static and/or dynamic friction and/or exhibits greater wear resistance.

Aspect 15. The rotary pump according to any one of the preceding two aspects, wherein the functional material is a lubricated thermoplastic.

Aspect 16. The rotary pump according to any one of the preceding three aspects, wherein the functional material is a polymer compound of at least one heat-resistant polymer filled with fibrous material and a sliding additive.

Aspect 17. The rotary pump according to the preceding aspect and at least one of the following Features (i) and (ii): the sliding additive comprises at least one of graphite and fluoropolymer, preferably PTFE; the fibrous material comprises or consists of carbon fibres.

Aspect 18. The rotary pump according to any one of the preceding two aspects, wherein the sliding material fulfils at least one of the following Features (i) to (iii): the proportion of polymer is at least 60% by weight and at most 80% by weight; the proportion of sliding additive is at least 10% by weight and at most 30% by weight; the proportion of fibrous material is at least 5% by weight and at most 15% by weight.

Aspect 19. The rotary pump according to any one of the preceding aspects, wherein the functional material is a plastic, and a base material of the plastic is a polymer including co-polymer, a mixture of polymers or a polymer blend from the group consisting of polyethersulphone (PES), polysulphone (PSU), polyphenylene sulphide (PPS), polyetherketones (PAEK, PEK, PEEK), polyamides (PA) such as for example PA4.6, and polyphthalamide (PPA).

Aspect 20. The rotary pump according to any one of the preceding aspects, wherein the material composite structure (20) comprises another functional region (31) which is fixedly connected to the moulded region (25) and made of a functional material which has a different chemical composition to the plastic of the moulded region (25), and the functional materials of the functional regions (26, 31) also differ from each other.

Aspect 21. The rotary pump according to the preceding aspect, wherein at least one of the functional materials is a sliding material, and the functional region (26) formed by the sliding material forms a sliding surface (27), preferably an inner or outer circumferential surface, of the material composite structure (20).

Aspect 22. The rotary pump according to any one of the preceding two aspects, wherein at least one of the functional regions (31) supports and/or rigidifies the moulded region (25) and/or the functional region (26) which forms the sliding surface (27) of Aspect 20, Aspect 23. The rotary pump according to any one of the preceding three aspects, wherein one of the functional regions (26, 31) surrounds the other on the outside over its entire circumference or at least over a predominant portion of its circumference, preferably in direct contact.

Aspect 24. The rotary pump according to any one of the preceding aspects, wherein the supporting and/or rigidifying functional region (31) comprises recesses, preferably radial recesses, which can be formed as passages, and the functional material has penetrated into the recesses or penetrated through the recesses which are preferably formed as passages.

Aspect 25. The rotary pump according to any one of the preceding aspects, wherein the setting structure (20) comprises an inner circumferential surface (27) which directly faces the delivery rotor (10) and serves as a sliding surface, and the functional region (26) forms the inner circumferential surface by itself or in combination with the moulded region (25).

Aspect 26. The rotary pump according to any one of the preceding aspects, wherein the functional region (16; 26; 31) is or comprises a hollow profile which is preferably annular, tubular or sleeve-shaped and exhibits a thickness which is constant or varying over its circumference and which is smaller, preferably by at least a factor of three, than an inner diameter of the hollow profile.

Aspect 27. The rotary pump according to any one of the preceding aspects, wherein the functional region (16) comprises a hollow profile which is preferably annular or tubular and exhibits a thickness which is constant or varying over its circumference, and projections project outwards from the hollow profile and protrude into the moulded region (15), in order to stabilise the moulded region (15).

Aspect 28. The rotary pump according to any one of the preceding aspects, wherein the plastic of the moulded region is a thermoplastic filled with particles, preferably fibres, made of glass and/or mineral and/or carbon.

Aspect 29. The rotary pump according to any one of the preceding aspects, wherein the plastic of the moulded region is Vyncolit®, in particular Vyncolit® X6320, or Fortron®.

Aspect 30. The rotary pump according to any one of the preceding aspects, wherein the rotary pump is a vane pump, and the delivery rotor (10) is a vane wheel comprising one or more vanes (12) which project outwards from the rotor structure (11) and are flexible or mounted by the rotor structure (11) such that they can be moved and which sweep over an inner circumferential surface (27) of the setting structure (20) when the delivery rotor (10) is rotated.

Aspect 31. The rotary pump according to the preceding aspect, wherein: the vane or vanes (12) is/are (each) mounted in an assigned slot (13) of the rotor structure (11) such that it/they can be moved relative to the rotor structure (11); each assigned slot (13) comprises opposing slot walls which face each other and delimit the respective slot (13) in the circumferential direction; and the vane or vanes (12) is/are (each) in sliding contact with at least one of the slot walls in the assigned slot (13); and wherein the functional region (16; 26) which consists of a sliding material, preferably in accordance with Aspect 13, forms the slot surface, which is in sliding contact with the respective vane (12), as a sliding surface (17).

Aspect 32. The rotary pump according to Aspect 30, wherein: the vane or vanes (12) is/are (each) mounted in an assigned slot (13) of the rotor structure (11) such that it/they can be moved relative to the rotor structure (11); each assigned slot (13) comprises opposing slot walls which face each other and delimit the respective slot (13) in the circumferential direction; and the vane or vanes (12) is/are (each) in sliding contact with at least one of the slot walls in the assigned slot (13); and wherein the moulded region (15) forms the slot surface, which is in sliding contact with the respective vane (12), as a sliding surface (14) and the functional region (16) respectively protrudes between slots (13) which are adjacent in the circumferential direction and thus stabilises the moulded region (15).

Aspect 33. The rotary pump according to any one of the preceding aspects, wherein the material composite structure (11), preferably the rotor structure, is fixed or movably mounted on another component of the rotary pump in the region of a circumferential surface (19), preferably an inner circumferential surface, and the functional region (16) forms the circumferential surface (19) of the material composite structure (11), wherein the functional region (16) preferably also forms the functional region of aspect 31 or aspect 32.

Aspect 34. The rotary pump according to the preceding aspect, wherein the circumferential surface (19) exhibits a non-circular cross-section, preferably in the form of a toothing, at least in an axial portion, in order to non-rotationally connect the material composite structure (11) to a shaft.

Aspect 35. The rotary pump according to any one of the preceding aspects, wherein the rotor structure (11) comprises a joining surface (19), which is formed as a circumferential surface, and is non-rotationally connected via the joining surface (19) to a shaft, which can be rotated about the rotational axis ($R_{10}$) of the delivery rotor (10), in a positive fit in a preferably releasable joining engagement, and the functional region (16) forms the joining surface (19) of the rotor structure (11).

Aspect 36. The rotary pump according to any one of the preceding aspects, wherein the rotary pump is a lubricating oil pump for supplying a unit with lubricating oil, preferably an engine oil pump for a drive motor of a vehicle, or a gas pump for delivering a gas, preferably a vacuum pump of a motor vehicle.

Aspect 37. The rotary pump according to any one of the preceding aspects, wherein the rotary pump is designed to be arranged in a motor vehicle and is designed for the delivery rotor (10) to be driven by a drive motor of the vehicle in a fixed rotational speed relationship to the drive motor.

Aspect 38. The rotary pump according to any one of the preceding aspects, wherein the functional region (16; 26; 31) is or comprises a hollow profile, and the moulded region (15) encloses the hollow profile on an axial end-facing side, preferably on both axial end-facing sides, and thus fixes it axially on the functional region (16).

Aspect 39. The rotary pump according to aspect 31, wherein the functional region (16) comprises a hollow profile and projections projecting outwards from the hollow profile and into the moulded region (15), the projections forming the slot surface, which is in sliding contact with the respective vane (12), as the sliding surface (17).

Aspect 40. The rotary pump according to aspect 32, wherein the functional region (16) comprises a hollow profile and projections projecting outwards from the hollow profile and into the moulded region (15) between slots (13), which are adjacent in the circumferential direction, thus stabilizing the moulded region (15).

BRIEF DESCRIPTION OF THE DRAWINGS

Example embodiments of the invention are described below on the basis of figures. Features disclosed by the example embodiments, each individually and in any combination of features, advantageously develop the subject-matter of the claims and aspects and also the embodiments described above. There is shown:

DETAILED DESCRIPTION OF THE INVENTION

Figure 1:
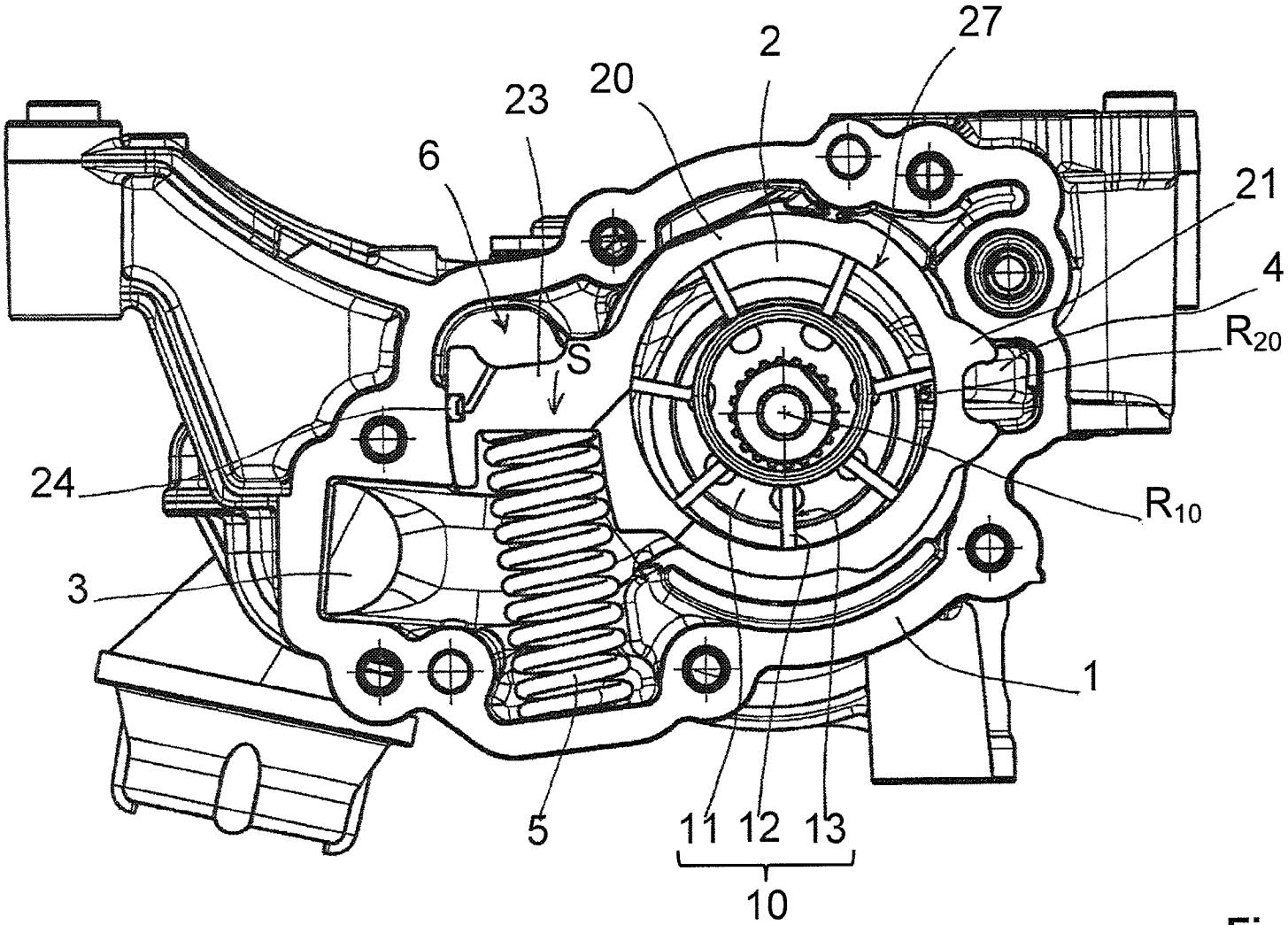
FIG. 1 a rotary pump comprising a rotor structure and a setting structure, at least one of which is formed in accordance with the invention as a material composite structure.

FIG. 1 shows a rotary pump in a vane cell design by way of example. The rotary pump is shown in a lateral view onto a housing 1 of the pump. A cover of the housing 1 has been removed, such that the functional components of the rotary pump can be seen. The housing 1 forms side walls of a delivery chamber 2 in which a delivery rotor 10 is arranged such that it can be rotated about a rotational axis $R_{10}$. The housing 1 comprises an inlet 3 and an outlet 4 for a fluid to be delivered, for example an engine lubricating oil. The delivery chamber 2 comprises a low-pressure side and a high-pressure side. When the delivery rotor 10 is rotary-driven in the rotational direction indicated, i.e. clockwise, fluid flows into the delivery chamber 2 via the inlet 3 on the low-pressure side and is expelled at an increased pressure on the high-pressure side and discharged via the outlet 4.

The delivery rotor 10 is a vane wheel comprising a rotor structure 11, which is central in relation to the rotational axis $R_{10}$, and vanes 12 which are arranged in a distribution over the circumference of the rotor structure 11. The vanes 12 are guided in slots 13 of the rotor structure 11, which are open towards the outer circumference of the rotor structure 11, such that they can be shifted, sliding, in a radial or at least substantially radial direction.

The rotor structure 11 is non-rotationally connected to a shaft, which can be rotated about the rotational axis $R_{10}$, in a joining engagement which is based on a positive fit. For the joining engagement, it comprises a non-circular inner circumferential surface, i.e. a joining surface which can in particular be formed in the manner of a toothing. The joining surface is preferably formed such that the rotor structure 11 can be pushed axially onto the shaft via its joining surface.

The outer circumference of the delivery rotor 10 is surrounded by a setting structure 20 which is formed as a setting ring by way of example. When the delivery rotor 10 is rotary-driven, its vanes 12 slide over an inner circumferential surface 27 of the setting structure 20. The rotational axis $R_{10}$ of the delivery rotor 10 is arranged eccentrically with respect to a parallel central axis of the setting structure 20, such that delivery cells formed by the delivery rotor 10 and the setting ring 20 increase in size in the rotational direction on the low-pressure side of the delivery chamber 2 and decrease in size again on the high-pressure side when the delivery rotor 10 is rotated. Due to this increase and decrease in the size of the delivery cells which is periodic with the rotational speed of the delivery rotor 10, the fluid is delivered from the low-pressure side to the high-pressure side, where it is delivered at an increased pressure through the outlet 4.

The volume of fluid which is delivered per revolution of the delivery rotor 10, the so-called specific delivery volume, can be adjusted. If the fluid is a liquid and therefore—in a good approximation—incompressible, the absolute delivery volume is directly proportional to the rotational speed of the delivery rotor 10. In the case of compressible fluids, for example air, the relationship between the delivered amount and the rotational speed is not linear, but the absolute delivered amount and/or mass does likewise increase with the rotational speed.

The specific delivery volume depends on the eccentricity, i.e. the distance between the central axis of the setting structure 20 and the rotational axis $R_{10}$ of the delivery rotor 10. In order to be able to change this axial distance, the setting structure 20 is arranged such that it can be moved in the housing 1, for example such that it can be pivoted about a pivot axis $R_{20}$. In variations, a modified setting structure can also be arranged such that it can be linearly moved in the housing 1. In order to adjust the specific delivery volume and/or eccentricity, an ability to move transverse to the rotational axis $R_{10}$ of the delivery rotor 10 is preferred. An axial adjustability would also be conceivable in principle, using which an axial width of the delivery cells can be adjusted.

A pivot bearing region of the setting structure 20 is indicated by 21. The pivot bearing is embodied as a slide bearing, in that the pivot bearing region 21 of the setting structure 20 is in direct sliding contact with a co-operating surface of the housing 1.

For adjusting in a setting direction S—in the example embodiment, the pivoting direction S—a control fluid pressure which acts in the setting direction S is applied to the setting structure 20. A restoring force acts in the opposite setting direction, counter to this control pressure. The restoring force is generated by a spring device comprising one or more mechanical spring members—in the example embodiment, a single spring member 5. The spring member 5 is embodied and arranged as a helical pressure spring. For applying pressure using the control fluid, the opposing side of the setting structure 20 as viewed from the pivot axis $R_{20}$ across the rotational axis $R_{10}$ of the delivery rotor 10 comprises an acting region 23 of the setting structure 20 which functionally acts as a setting piston and is for example formed in one piece with an annular part of the setting structure 20. A control pressure chamber 6 is formed in the housing 1, to one side of the acting region 23 of the setting structure 20, wherein the control fluid can be introduced into the control pressure chamber 6 in order to exert a setting force, which acts in the setting direction S, on the acting region 23 of the setting structure 20 and, via the acting region 23, on the setting structure 20. The restoring force likewise for example acts directly on the acting region 23 of the setting structure 20.

The control pressure chamber 6 is fed with the pressure fluid delivered by the rotary pump, in order to apply the control fluid pressure to the setting structure 20 in the setting direction S. The setting direction S is selected such that the eccentricity between the delivery rotor 10 and the setting structure 20 and therefore the specific delivery volume decreases in size when the setting structure 20 is moved in the setting direction S.

The setting structure 20 and the housing 1 together form a sealing gap which separates the control pressure chamber 6 from the low-pressure region in the setting direction S. A sealing element is arranged in the radial sealing gap in order to better seal off the sealing gap. The sealing element is arranged in a receptacle 24 of the setting structure 20.

With respect to controlling or regulating the delivery volume by applying the control fluid pressure as described, reference is made to DE 10 2011 086 175 B3, which is incorporated by reference in this respect and also with respect to other details of the functionality of the rotary pump.

The setting structure 20 and/or the rotor structure 11 is/are (each) material composite structures which consist entirely or at least in regions of plastic. They are however produced from at least two materials which differ from each other in terms of their chemical composition and optionally also in terms of added substances.

Figures 2, 3, 4:
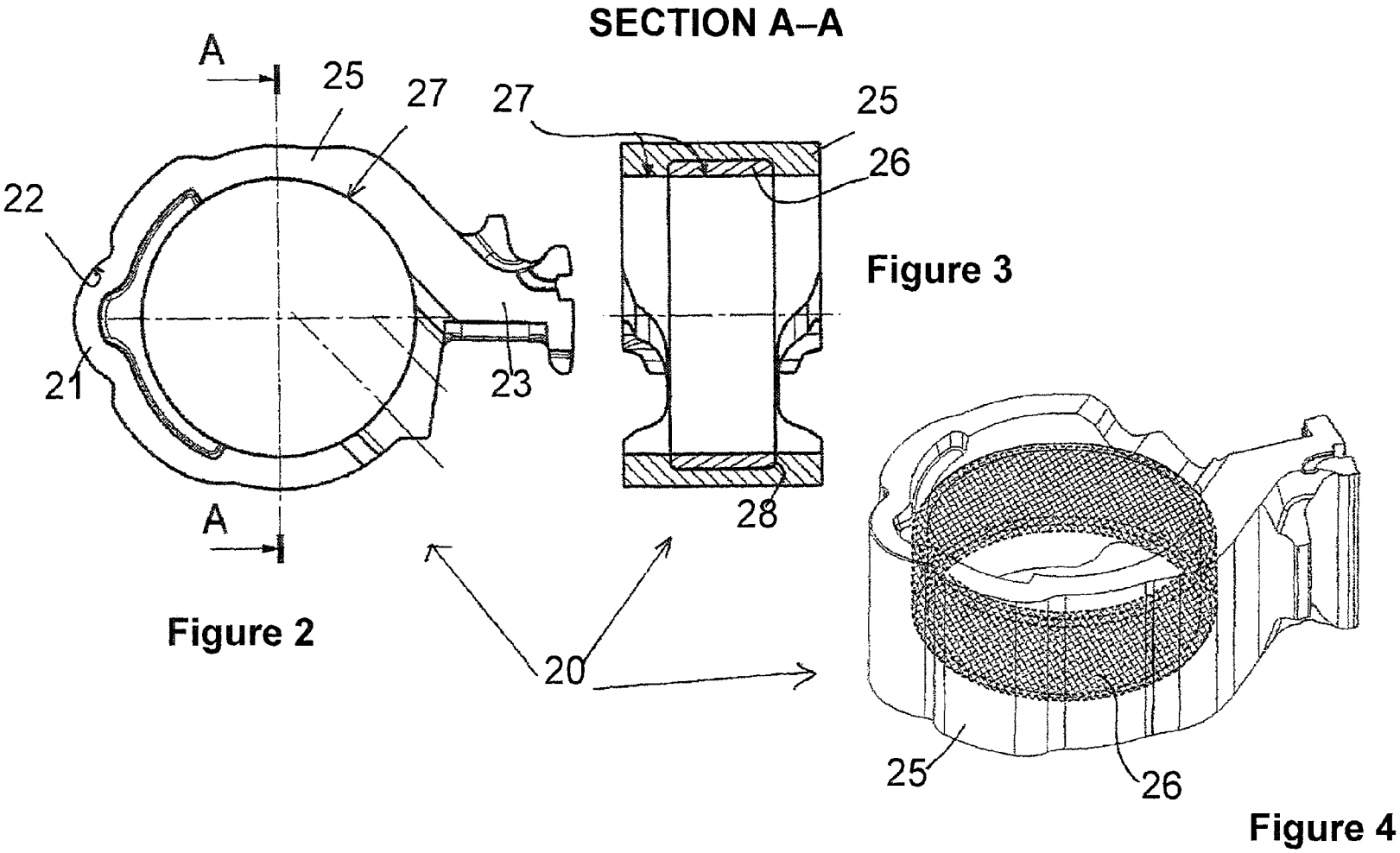
FIG. 2 a first example embodiment of the setting structure formed as a material composite structure, in a lateral view.
FIG. 3 the section A-A from FIG. 2.
FIG. 4 the setting structure of the first example embodiment, in an isometric representation.

FIGS. 2 to 4 show a material composite structure of a first example embodiment. The setting structure 20 is the material composite structure. The setting structure 20 comprises a moulded region 25 made of plastic and a functional region 26 made of a functional material which differs in its chemical composition from the plastic of the moulded region 25. The functional material can be another plastic or in particular a metal or metal alloy. It is preferably steel. The functional region 26 can advantageously be a cast body or a sintered body. The functional region 26 is annular, tubular or sleeve-shaped. It can exhibit an at least substantially smooth surface, in particular a smooth inner circumferential surface.

The functional region 26 is embedded in the moulded region 25. The moulded region 25 also surrounds the functional region 26 over its entire outer circumference. The moulded region 25 encompasses the functional region 26 at both axial ends. For this purpose, the functional region 26 is embedded in a groove-shaped or hollow-shaped recess 28 which encircles the inner circumference of the moulded region 25. The moulded region 25 correspondingly encloses the functional region 26 over its outer circumference and axially on both sides, such that the moulded region 25 and the functional region 26 are fixedly connected in a positive fit, such that they cannot move axially relative to each other. A relative movement in the circumferential direction is prevented by the functional region 26 being encompassed correspondingly fixedly. The moulded region 25 and the functional region 26 together form the smooth inner circumferential surface 27 of the setting structure 20 as a sliding surface.

The complete setting structure 20 is advantageously formed by just the moulded region 25 and the functional region 26 alone.

The functional region 26 forms an insert in the material composite structure 20. As already mentioned, the functional region 26 can be a steel insert or other metallic insert or also a plastic insert. Preferably, the functional region 26 is sufficiently rigid, such that it can serve as a supporting and/or rigidifying body for the moulded region 25 within the setting structure 20, i.e. the moulded region 25 can be supported on the functional region 26 and/or the dimensional stability of the setting structure 20 during pump operations can be improved. Instead of or in combination with a supporting and/or rigidifying function, the functional region 26 can be produced from or coated with a sliding material, wherein the sliding material can exhibit the same or preferably a lower coefficient of friction than the plastic of the moulded region 25 in relation to dynamic friction and preferably also in relation to static friction.

Figure 6:
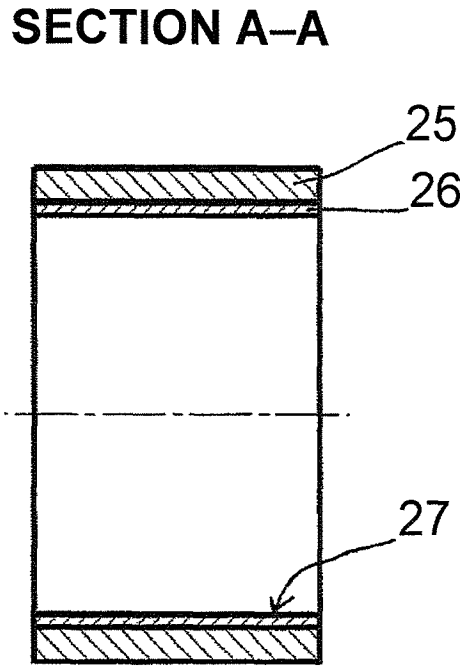
FIG. 6 the section A-A from FIG. 5.
Figure 5:
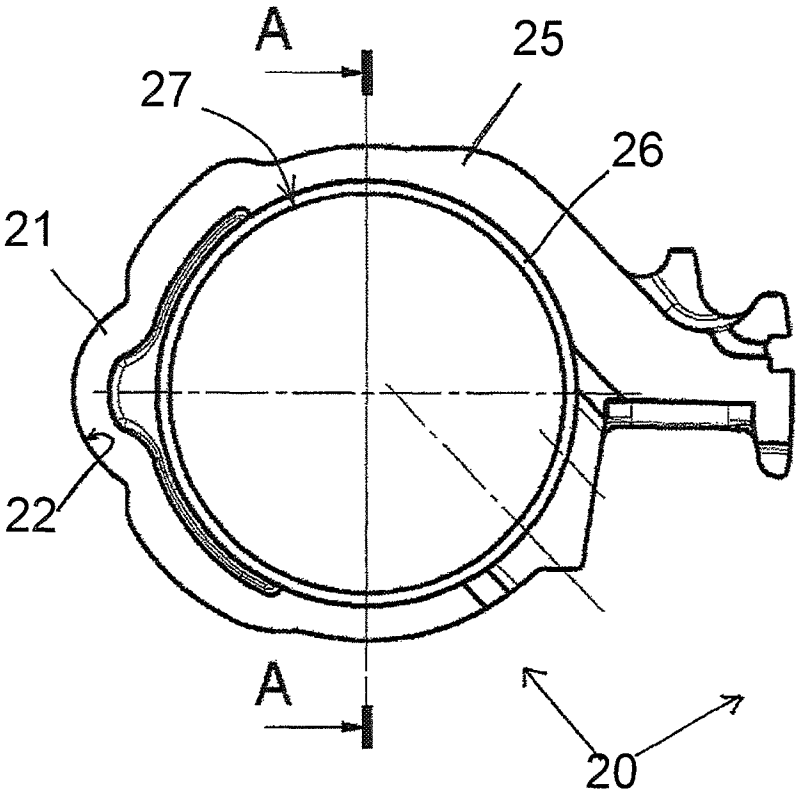
FIG. 5 a second example embodiment of the setting structure formed as a material composite structure, in a lateral view.

FIGS. 5 and 6 show a material composite structure of a second example embodiment. In the second example embodiment, the setting structure 20 is again the material composite structure. The setting structure 20 differs from the first example embodiment merely in that the functional region 26 extends over the entire axial width of the setting structure 20 and therefore solely forms the inner circumferential surface 27 over which the vanes 12 of the delivery rotor 10 sweep when the delivery rotor 10 is rotary-driven. As in the first example embodiment above, the functional region 26 is annular, tubular or sleeve-shaped and exhibits a wall thickness which is smaller than the inner diameter.

Figure 8:
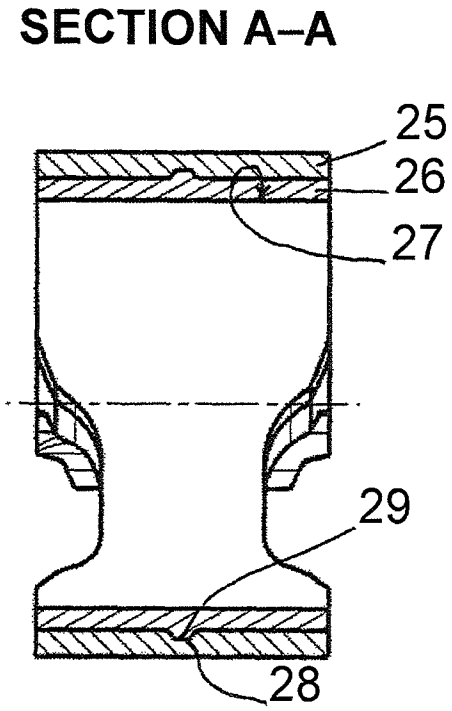
FIG. 8 the section A-A from FIG. 7.
Figure 7:
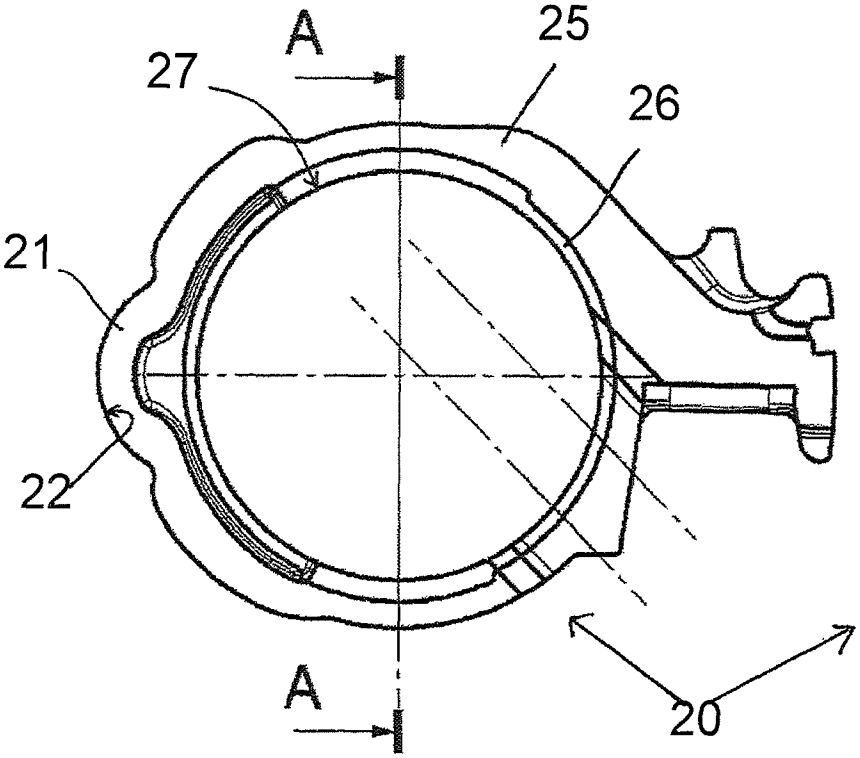
FIG. 7 a third example embodiment of the setting structure formed as a material composite structure, in a lateral view.

A third example embodiment of a material composite structure 20, again the setting structure 20, is shown in FIGS. 7 and 8. As in the second example embodiment, the functional region 26 again extends over the entire axial width of the setting structure 20 in the third example embodiment. The functional region 26 differs from that of the second example embodiment by a radial projection 29 which is provided on the outer circumference and engages with a groove-shaped recess 28 of the moulded region 25 and thus axially secures the functional region 26 to the moulded region 25 in addition to being fixedly encompassed by the moulded region 25. The functional region 26 in the third example embodiment otherwise corresponds to the functional region 26 of the second example embodiment. The recess 28 and the projection 29 can be completely or only partially formed circumferentially and can engage with each other.

Figures 9, 10, 11:
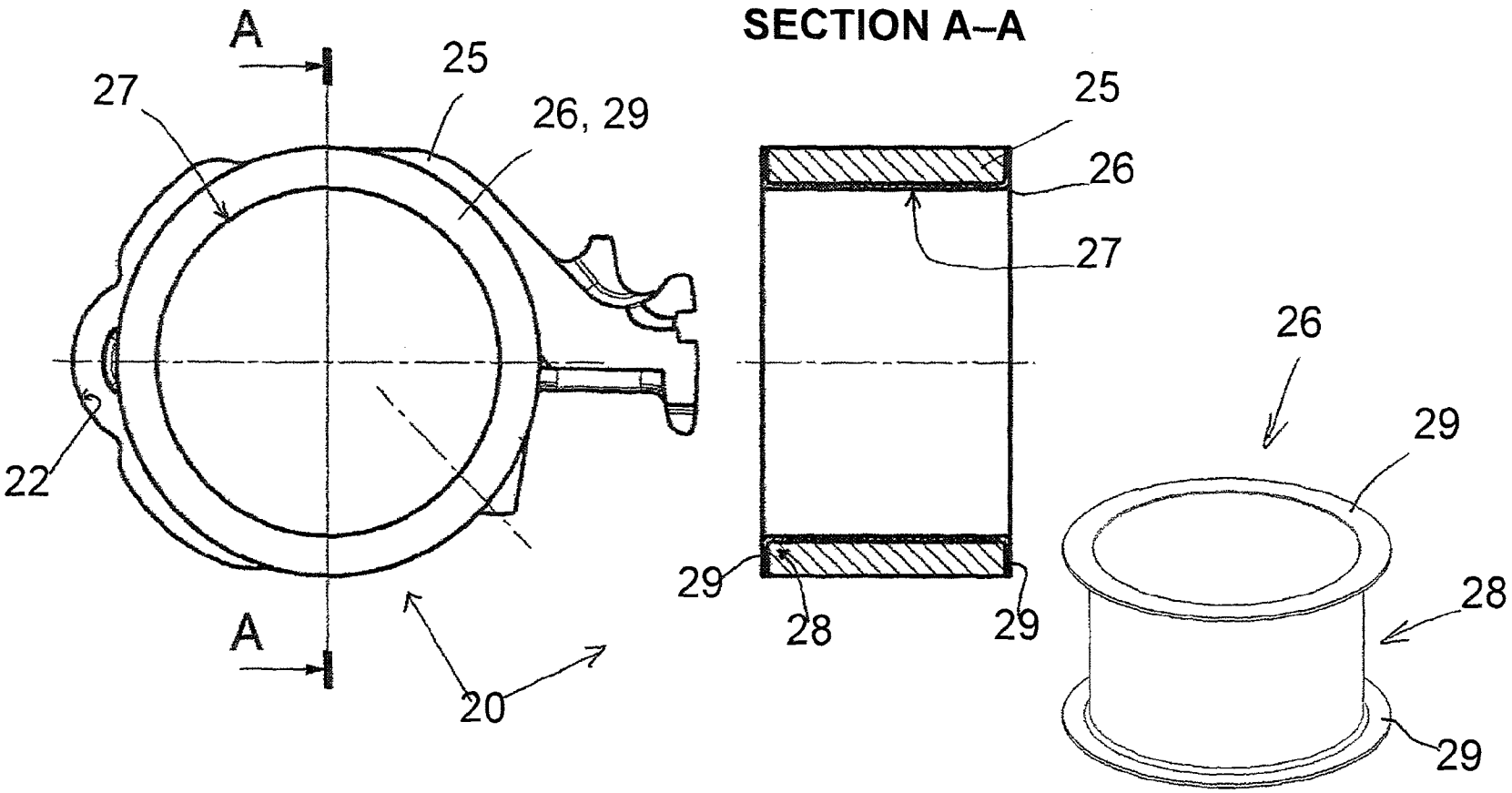
FIG. 9 a fourth example embodiment of the setting structure formed as a material composite structure, in a lateral view.
FIG. 10 the section A-A from FIG. 9.
FIG. 11 a functional insert of the fourth example embodiment, in an isometric representation.

FIGS. 9 and 10 show a fourth example embodiment of a setting structure 20 formed as a material composite structure. In the fourth example embodiment, the functional region 26 encloses the moulded region 25 axially on both sides, in that the two axial ends of the functional region 26, which is formed substantially as a thin-walled tube, each comprise a flange 29 which projects outwards and can advantageously extend over the entire circumference. The functional region 26 correspondingly forms a recess 28 axially between the two flanges 29, wherein the moulded region 25 engages with the recess 28 and fills in the recess 28, as is preferred. The two flanges 29 axially secure the functional region 26. The moulded region 25 additionally encompasses, in a force fit, the axial portion of the functional region 26 which extends between the flanges 29. As preferably also in the other example embodiments, a force fit can be created when the plastic of the moulded region is moulded around the functional insert 26 by the solidifying of the plastic of the moulded region 25. As in the previous example embodiments, the functional region 26 can serve as a supporting and/or rigidifying structure for the moulded region 25. The functional region 26 additionally forms the inner circumferential surface 27 and is therefore preferably produced from a sliding material which exhibits the good sliding properties and wear resistance required for pump operations. Aside from the differences described, the statements made with respect to the other example embodiments apply similarly to the fourth example embodiment. The functional region 26 can thus in particular have been provided as an insert and the plastic of the moulded region can have been moulded, preferably injected, around it.

FIG. 11 shows the functional region 26 by itself, isolated from the material composite structure 20. As in the example embodiments described above, the functional region 26 can in particular form a metal or plastic insert, preferably a steel insert, within the material composite structure 20.

Figure 13:
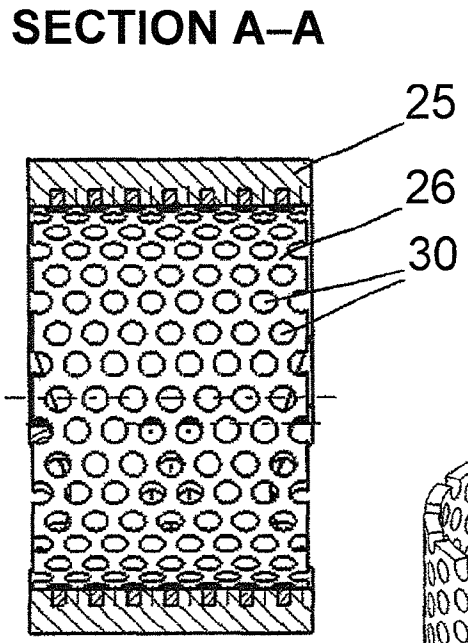
FIG. 13 the section A-A from FIG. 12.
Figure 12:
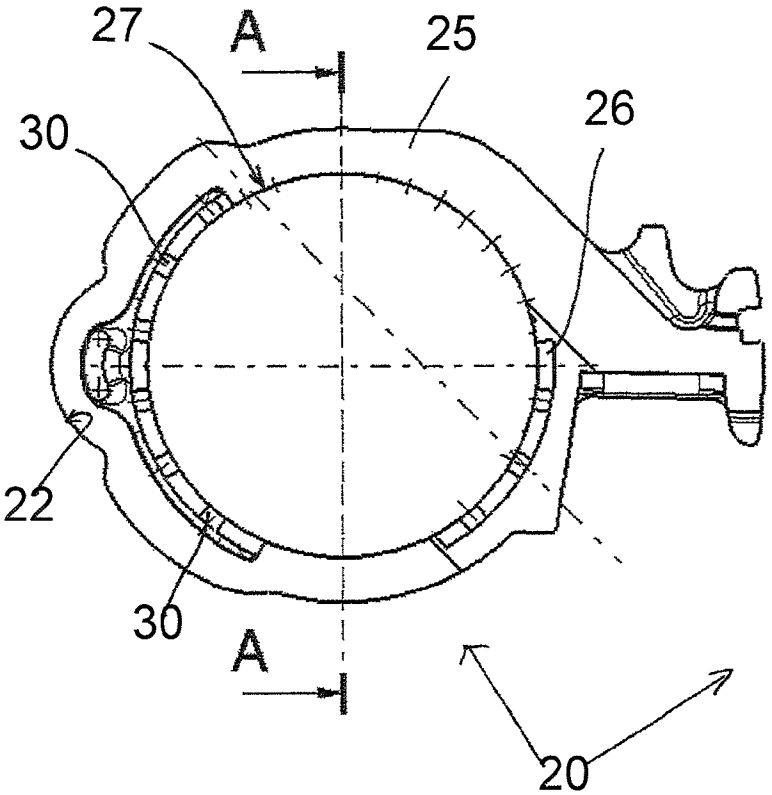
FIG. 12 a fifth example embodiment of the setting structure formed as a material composite structure, in a lateral view.

FIGS. 12 and 13 illustrate a fifth example embodiment of a setting structure 20 formed as a material composite structure. The setting structure 20 of the fifth example embodiment is also composed of two regions only, namely the moulded region 25 made of plastic and the functional region 26 made of a functional material. As in the example embodiments described above, the functional region 26 is annular, tubular or sleeve-shaped and exhibits a wall thickness which is smaller than the inner diameter. It comprises a multitude of passages 30 in a distribution over its circumference. The functional region 26 can also be referred to as a perforated hollow structure. The plastic of the moulded region 25 has penetrated through the passages 30, such that the moulded region 25 and the functional region 26 are anchored to each other and a particularly tight positive fit is obtained.

Figure 14:
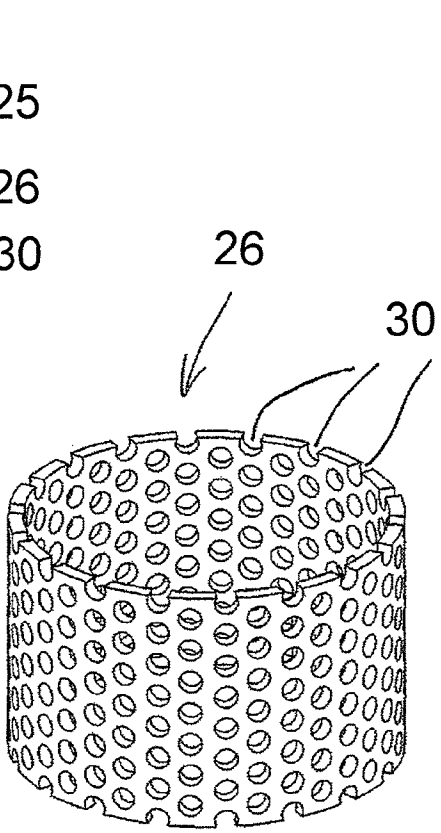
FIG. 14 a functional insert of the fifth example embodiment, in an isometric representation.

The annular, tubular or sleeve-shaped insert 26, which forms the functional region 26 in the material composite structure 20, is shown by itself, isolated from the material composite structure, in FIG. 14. In this prefabricated state, the functional region 26 or the structural part and/or insert which forms it, respectively, can be placed into a die, and the plastic of the moulded region 25 can be moulded, preferably injected, around it. In such a method of original moulding, the plastic of the moulded region 25 preferably penetrates into the passages 30 and thus anchors the functional region 26 to the moulded region 25.

The functional region 26 can support and/or rigidify the moulded region 25. As an alternative to or in addition to the supporting and/or rigidifying function, the functional region 26 can—if the functional material forming it is a sliding material with sufficiently good sliding properties and wear resistance—form the inner circumferential surface 27, either by itself or, if the plastic of the moulded region 25 has completely penetrated through the passages 30, together with the plastic of the moulded region 25.

In modifications, the functional regions 26 of the first to fifth example embodiment can be surrounded on the outside and inside by the plastic of the moulded region 25 or can also be completely embedded in the plastic of the moulded region 25, such that they do not have a sliding function in the modifications but rather only a supporting and/or rigidifying function for the material composite structure 20. The inner circumferential surface 27 which serves as a sliding surface is formed by the plastic of the moulded region 25 in the modifications.

In other modifications, the functional regions 26 of the first to fourth example embodiment can additionally comprise passages, such as for example the passages 30, in order to anchor the regions 25 and 26 to each other in addition to the positive fit existing in the respective example embodiment. In all the examples, the functional region 26 can similarly comprise a fin which protrudes outwards or a protruding flange at one or both axial ends and/or the functional region 26 there can be axially embedded, as for example in the first example embodiment, instead of extending over the entire axial length of the setting structure 20.

Figure 15:
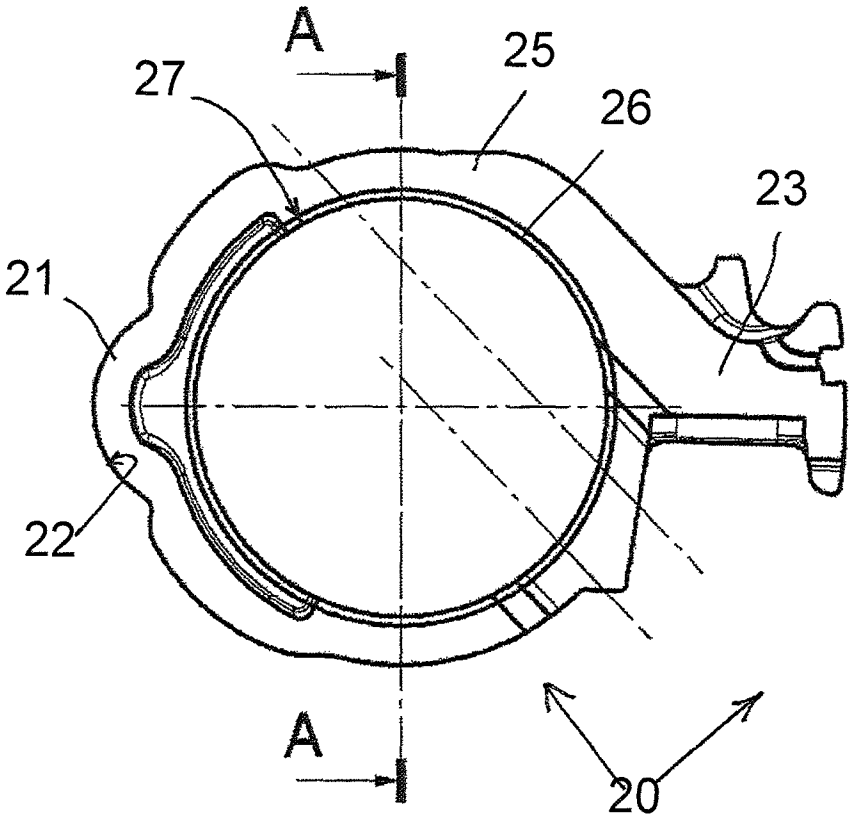
FIG. 15 a sixth example embodiment of the setting structure formed as a material composite structure, in a lateral view.
Figure 16:
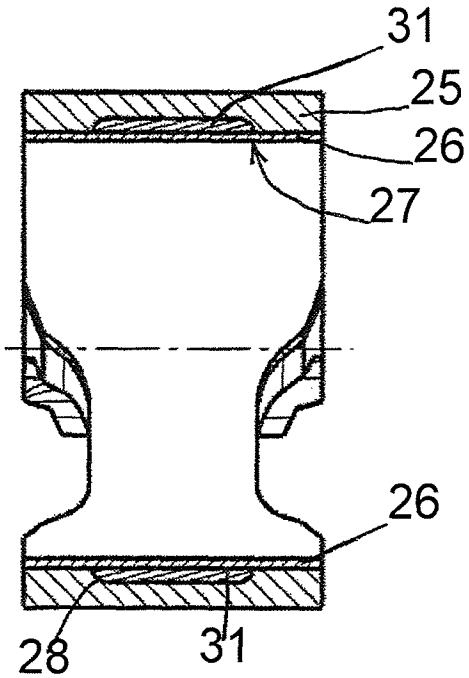
FIG. 16 the section A-A from FIG. 15.

FIGS. 15 and 16 show a sixth example embodiment of a setting structure 20 formed as a material composite structure. This setting structure 20 comprises a moulded region 25 which, as in the example embodiments described above, forms the bearing region 21 comprising the slide bearing surface 22 and, on the opposing side, the acting region 23 in one piece. The setting structure 20 also comprises a first functional region 26 made of a first functional material and another, second functional region 31 made of a second functional material. The first and also the second functional material differ from the plastic of the moulded region 25 at least with regard to their chemical composition. In preferred embodiments, they also differ from each other in their chemical composition.

If the functional materials are plastics, they can differ from each other at least with regard to their added substances. One functional material can thus for example be a fibre-reinforced plastic and the other can be a plastic with no fibre reinforcement or a plastic with a different type of fibres. If both functional materials are formed as plastics, then the plastic forming the functional region 26 can for example contain carbon fibres, in order to obtain good sliding properties for the inner circumferential surface 27 which serves as a sliding surface and is formed solely or at least in part by the functional region 26.

The functional material of the functional region 31 can for example be fibreglass-reinforced or can consist of a plastic which is more dimensionally stable than the functional material of the functional region 26. In a preferred combination of materials, the functional region 26 consists of plastic or metal exhibiting good sliding properties and sufficient wear resistance, and the second functional region 31 consists of metal, preferably steel.

The first functional region 26 and/or the second functional region 31 is/are (each) preferably provided as a prefabricated insert, advantageously made of a metallic material or a plastic. In preferred embodiments, the second functional region 31 serves as a supporting and/or rigidifying structure and can in particular consist of a metallic material, preferably steel, in such embodiments. It can for example be provided as a prefabricated sintered body or cast body. The first functional region 26 and/or in particular the second functional region 31 can (each) comprise passages, for example passages such as the passages 30 of the previous example embodiment, wherein the plastic material of the moulded region 25 can correspondingly penetrate through the passages as the moulded region 25 is originally moulded, in order to obtain a tight positive fit.

When manufacturing the material composite structure 20, the two functional regions 26 and 31, which are in particular provided as inserts, can be placed into a die, for example a plastic injection-moulding die, and the plastic of the moulded region 25 can be moulded, preferably injected, around them.

Wherever no particularities of the respective example embodiment have been described or can be seen from the figures with respect to the first to sixth example embodiment, the statements made with respect to each of the respective example embodiments also apply to each of the other respective example embodiments.

In the example embodiments, the functional region 26 and also the other functional region 31 are each formed at least substantially as a hollow profile structure and surround the inner cross-section of the setting structure 20 which remains free and in which the delivery rotor 10 is arranged. Although these embodiments are particularly advantageous, a functional region made of a material which differs from the plastic of the moulded region 25 as described can instead also form a different region of the setting structure 20. The sliding surface 22 of the bearing region 21, or the entire bearing region 21 as such a functional region, can thus for example be formed from a functional material. The functional material of such a functional region is preferably a sliding material which exhibits good sliding properties and sufficient wear resistance for the dynamic friction stresses which occur in the pivot bearing of the setting structure 20. Such a functional region can be provided additionally or in principle also instead of the functional regions 26 and 31 described.

Figure 18:
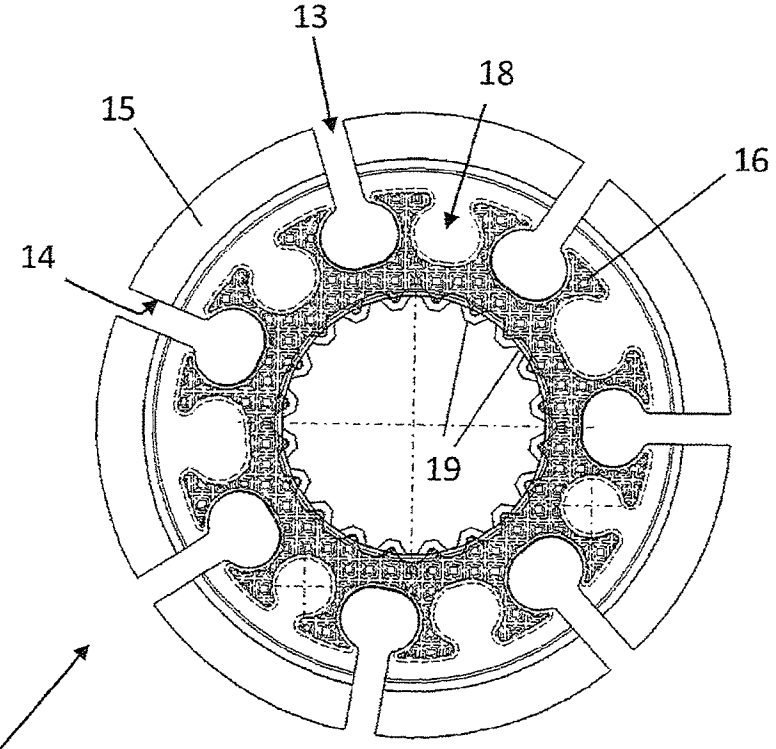
FIG. 18 the material composite structure of the seventh example embodiment, in a cross-section from FIG. 17.
Figure 17:
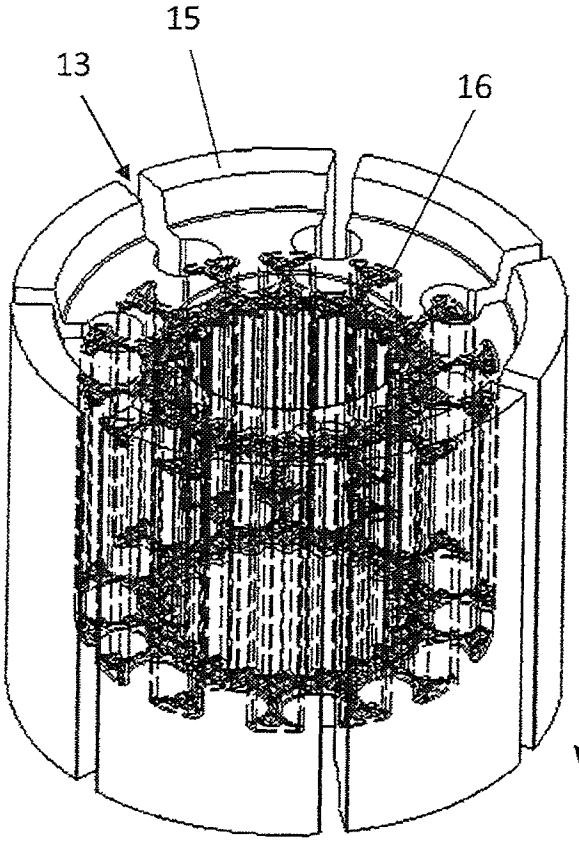
FIG. 17 the rotor structure formed as a material composite structure of a seventh example embodiment, in an isometric representation.

FIGS. 17 and 18 show a material composite structure of a seventh example embodiment which can form the rotor structure 11 in the rotary pump and which is correspondingly provided with the reference sign "11". The central region of the rotor structure 11 comprises a passage which is enclosed by an inner circumferential surface. The inner circumferential surface is formed as a joining surface 19 for establishing a non-rotational connection to a drive shaft of the rotary pump. The circumferential surface and/or joining surface 19 is therefore non-circular. In the example embodiment, it is formed in the manner of an inner toothing. The slots 13, in which the vanes 12 (FIG. 1) are guided such that they can be shifted radially or at least substantially radially, are broadened towards the base of the respective slot, in the shape of a pocket. In terms of its exterior shape, the rotor structure 11 can be formed like conventional rotor structures of vane pumps.

Unlike conventional rotor structures, however, the rotor structure 11 is embodied as a material composite structure and correspondingly comprises a moulded region 15 made of a plastic and a functional region 16 made of a functional material which has a different chemical composition to the plastic of the moulded region 15. That which has already been said with respect to the materials of the regions 25 and 26 of the material composite structure 20 applies similarly with regard to the materials of the regions 15 and 16. Thus, the functional material can in particular be a plastic or a metallic material, preferably a steel. That which has already been said with respect to their manufacture also applies. Thus, the functional region 16 can advantageously be provided as a prefabricated insert, and the plastic of the moulded region 15 can be moulded, preferably cast and in particular injected, around it.

In the seventh example embodiment, the functional region 16 forms the joining surface 19, and therefore serves as a joining region, and supports and rigidifies the moulded region 15. The functional region 16 comprises recesses 18 in a distribution over its circumference, wherein the plastic of the moulded region 15 has penetrated into the recesses 18 as the moulded region 15 is originally moulded. The recesses 18 are widened radially inwards in the shape of pockets, as is preferred, such that the plastic of the moulded region 15 not only surrounds the functional region 16 over its circumference on the outside but also grips behind at the openings of the pockets and/or recesses 18 as viewed from the outer circumference, thus achieving an anchoring effect.

When entering and exiting, the vanes 12 (FIG. 1) slide in the slots 13 on the lateral slot walls which correspondingly form sliding surfaces 14 for the vanes 12. The slots 13 are formed in the moulded region 15 such that the plastic of the moulded region 15 forms the sliding surfaces 14. The functional region 16 comprises a central hollow profile, the inner circumferential surface of which is the joining surface 19. The functional region 16 also comprises projections which project radially outwards from the hollow profile and enclose the slots 13 in the region of the respective base of the slot. The recesses 18 are formed between respectively adjacent projections.

Figure 20:
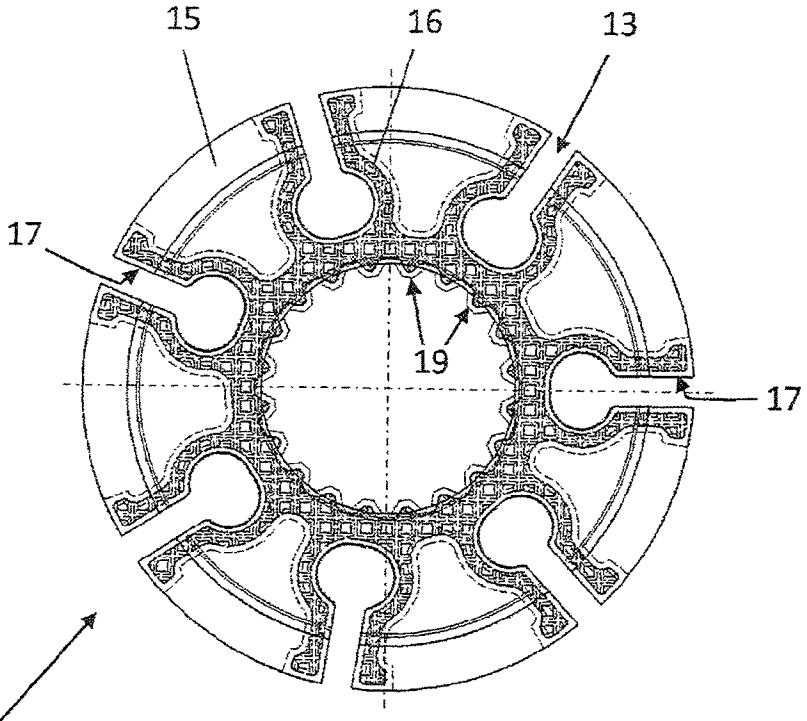
FIG. 20 the material composite structure of the eighth example embodiment, in a cross-section from FIG. 19.
Figure 19:
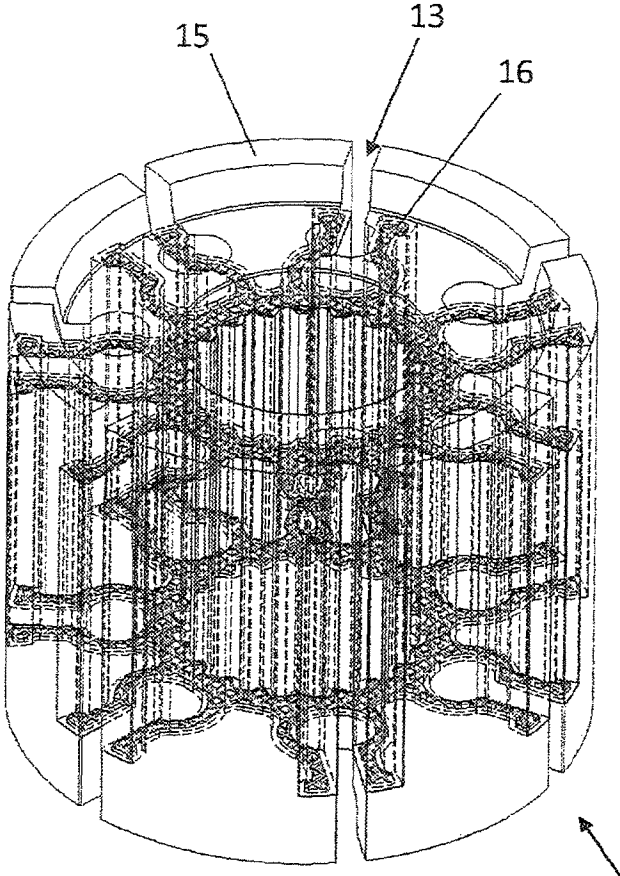
FIG. 19 a rotor structure formed as a material composite structure of an eighth example embodiment, in an isometric representation.

FIGS. 19 and 20 show an eighth example embodiment of a material composite structure, again taking the example of the rotor structure 11. In terms of its exterior shape, the rotor structure 11 of the eighth example embodiment corresponds to that of the seventh example embodiment. As in the seventh example embodiment, the rotor structure 11 forms the joining surface 19 for the positive-fit join connection to the drive shaft and supports and rigidifies the moulded region 15. Unlike the seventh example embodiment, the functional region 16 also forms the side walls of the slots 13 for the vanes 12, which are leading and trailing side walls in the circumferential direction, in the form of the sliding surfaces 17. The functional material which forms the functional region 16 is therefore expediently a sliding material which exhibits good sliding properties and sufficient wear resistance. At the location of the slots 13 on the outer circumference, the functional region 16 comprises short projections which extend in the circumferential direction, such that the plastic of the moulded region 15—which has penetrated into the recesses of the functional region 16 which remain between the slots 13—grips behind the projections of the functional region 16 and thus improves anchoring.

In the eighth example embodiment, the functional region 16 extends as far as the outer circumference of the rotor structure 11. As can be seen in FIG. 19, the moulded region 15 protrudes beyond the functional region 16 in the axial direction, such that the moulded region 15, as in the seventh example embodiment, and otherwise also the moulded region 25 of the setting structures 20 is formed as a single continuous region.

Figure 22:
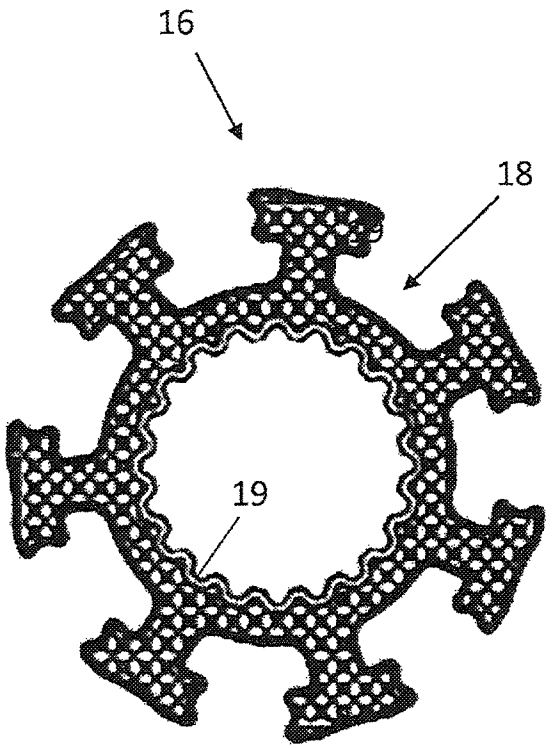
FIG. 22 a functional insert of the ninth example embodiment, in an axial facing view.
Figure 21:
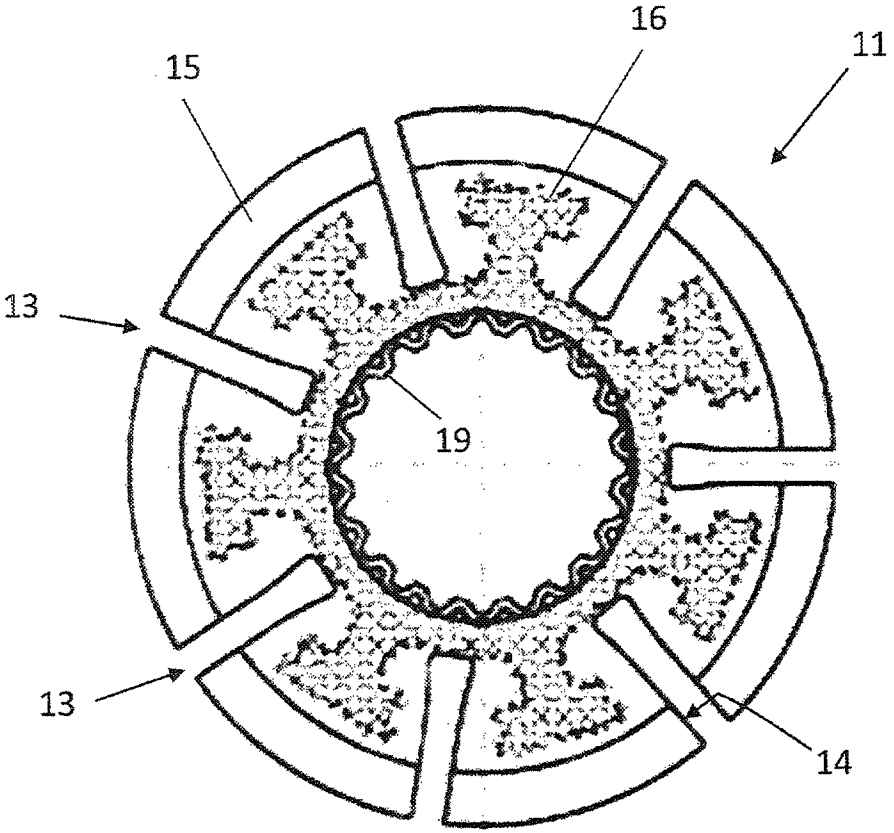
FIG. 21 a rotor structure formed as a material composite structure of a ninth example embodiment, in an axial facing view.

FIGS. 21 and 22 show a ninth example embodiment of a material composite structure, taking the example of the rotor structure 11. In terms of its exterior shape, the rotor structure 11 of the ninth example embodiment corresponds to those of the seventh and eighth example embodiment. As in the seventh and eighth example embodiment, the rotor structure 11 forms the joining surface 19 for the positive-fit join connection to the drive shaft and supports and rigidifies the moulded region 15. As in the seventh example embodiment, the moulded region 15 forms the side walls of the slots 13 for the vanes 12, which are leading and trailing side walls in the circumferential direction, in the form of the sliding surfaces 14. As in the seventh and eighth example embodiment, the functional region 16 comprises a hollow profile featuring a joining surface 19 which is formed as an inner circumferential surface. As in these two example embodiments, projections project outwards from the hollow profile and protrude into the plastic of the moulded region 15, thus providing large pressure surfaces, which extend in a radial direction, for transmitting the torque.

Unlike the two preceding example embodiments, the functional material does not line the slots 13, not even the base of the slots as it still does in the seventh example embodiment. The projections are offset in the circumferential direction with respect to the slots 13. They respectively protrude between adjacent slots 13, into the moulded region 15 which surrounds the functional region 16. The projections are widened radially on the outside in a mushroom shape, such that the moulded region 15 and the functional region 16 grip behind each other as viewed from the outer circumference and from the joining surface 19. The plastic of the moulded region 15 surrounds the projections on the outer circumference and also on the sides which are leading and trailing sides during rotation. The projections stabilise the moulded region and sub-divide it into smaller sub-regions, which improves the dimensional stability of the rotor structure 11 over its working temperature range.

In the eighth and ninth example embodiment, the functional region 16 can again advantageously be provided as a prefabricated insert, preferably made of metal or plastic and particularly preferably made of steel, and the plastic of the moulded region 15 can be moulded, advantageously cast and in particular injected, around it.

Wherever no particularities have been described or can be seen from the figures with respect to the rotor structures 11 of the example embodiments, the statements made with respect to the setting structures 20 apply similarly with regard to the materials and to moulding the plastic of the respective moulded region 15 around them.

REFERENCE SIGNS

1 housing
2 delivery chamber
3 inlet
4 outlet
5 spring member
6 control pressure chamber
7 -
8 -
9 -
10 delivery rotor
11 rotor structure, material composite structure
12 vane
13 slot
14 slot wall, sliding surface
15 moulded region
16 functional region
17 slot wall, sliding surface
18 recess
19 joining surface
20 setting structure, material composite structure
21 bearing region
22 bearing surface, sliding surface
23 acting region of the setting structure
24 sealing element receptacle
25 moulded region
26 functional region
27 inner circumferential surface, sliding surface
28 recess
29 projection
30 passage
31 functional region
$R_{10}$ rotational axis of the delivery rotor
$R_{20}$ pivot axis of the setting structure

The invention claimed is:

1. A rotary pump comprising:

a housing which comprises an inlet and an outlet for a fluid and comprises a delivery chamber which is connected to the inlet and the outlet;

a delivery rotor which can be rotated in the delivery chamber about a rotational axis and comprises a rotor structure which is central in relation to the rotational axis;

and a setting structure which surrounds the delivery rotor and together with the delivery rotor forms delivery cells, in order to deliver the fluid from the inlet to the outlet, and can be moved back and forth relative to the delivery rotor in order to be able to adjust a specific delivery volume of the rotary pump;

wherein at least the rotor structure, is a material composite structure and comprises a moulded region made of plastic and a functional region which is fixedly connected to the moulded region and made of a functional material which has a different chemical composition to the plastic of the moulded region, wherein the rotor structure comprises a plurality of slots to accommodate one or more vanes or pendulum sliders which can be moved into and out of the slots during operation of the rotary pump, and wherein the functional region forms a joining surface for a positive-fit connection to a drive shaft and comprises protrusions which extend between the adjacent slots inside the moulded region in a radial direction and/or wherein the functional region forms the joining surface for a positive-fit connection to the drive shaft and at least a part of the slots.

2. The rotary pump according to claim 1, wherein the functional region forms a sliding surface and/or a bearing or joining region of the material composite structure.

3. The rotary pump according to claim 1, wherein the functional region is manufactured separately from the moulded region, and the moulded region is moulded on or around the functional region in a method of original moulding wherein the regions are fixedly connected to each other.

4. The rotary pump according to claim 1, wherein the functional region and the moulded region are connected to each other in a positive fit, in that one of these regions protrudes into the other at one or more points, and/or the functional region and the moulded region are anchored to each other, in that one of these regions grips behind the other at one or more points, and/or a circumferential surface of the functional region comprises a surface structure featuring elevations and/or recesses, such that the moulded region and the functional region protrude radially into each other in the region of the surface structuring.

5. The rotary pump according to claim 1, wherein the functional region forms an inner region of the material composite structure, and the moulded region surrounds the functional region on the outside over a portion of its circumference or over its entire circumference.

6. The rotary pump according to claim 1, wherein the functional material is a sliding material and forms a sliding surface of the material composite structure.

7. The rotary pump according to claim 6, wherein the functional material is a thermoplastic which is lubricated and/or reinforced with fibers or particles.

8. The rotary pump according to claim 6, wherein the functional material is a plastic, and a base material of the plastic is a polymer including a co-polymer, a mixture of polymers or a polymer blend selected from the group consisting of polyethersulphone (PES), polysulphone (PSU), polyphenylene sulphide (PPS), polyetherketones (PAEK, PEK, PEEK), polyamides (PA) and polyphthalamide (PPA).

9. The rotary pump according to claim 1, wherein the material composite structure comprises another functional region which is fixedly connected to the moulded region and made of a functional material which has a different chemical composition to the plastic of the moulded region, and the functional materials of the functional regions also differ from each other.

10. The rotary pump according to claim 9, wherein at least one of the functional materials is a sliding material, and wherein the functional region formed by the sliding material forms a sliding surface of the material composite structure, and/or wherein the other functional region supports and/or rigidities the moulded region and/or the functional region which forms the sliding surface.

11. The rotary pump according to claim 1, wherein the setting structure comprises an inner circumferential surface which directly faces the delivery rotor and serves as a sliding surface, and the functional region forms the inner circumferential surface by itself or in combination with the moulded region and/or surrounds the inner circumferential surface over its entire circumference.

12. The rotary pump according to claim 1, wherein the functional region is or comprises a hollow profile which exhibits a thickness which is constant or varying over its circumference and which is smaller than an inner diameter of the hollow profile.

13. The rotary pump according to claim 12, wherein the thickness of the hollow profile is smaller than the inner diameter of the hollow profile by at least a factor of three.

14. The rotary pump according to claim 1, wherein the functional region comprises a hollow profile which exhibits a thickness which is constant or varying over its circumference, and projections project outwards from the hollow profile and protrude into the moulded region, in order to stabilise the moulded region.

15. The rotary pump according to claim 1, wherein the rotary pump is a vane pump, and the delivery rotor is a vane wheel comprising the one or more vanes which project outwards from the rotor structure and are flexible or mounted by the rotor structure such that they can be moved and which sweep over an inner circumferential surface of the setting structure when the delivery rotor is rotated.

16. The rotary pump according to claim 15, wherein: the vane or each of the vanes is mounted in an assigned slot of the rotor structure such that it can be moved relative to the rotor structure; each of the assigned slots comprises opposing slot walls which face each other and delimit the respective slot in the circumferential direction; the vane or each of the vanes is in sliding contact with at least one of the slot walls in the assigned slot; the moulded region forms the slot surface, which is in sliding contact with the respective vane, as the sliding surface and the functional region comprises a hollow profile and projections projecting outwards from the hollow profile and into the moulded region between the slots which are adjacent in the circumferential direction and thus stabilises the moulded region.

17. The rotary pump according to claim 15, wherein: the vane or each of the vanes is mounted in an assigned slot of the rotor structure such that it can be moved relative to the rotor structure; each assigned slot comprises opposing slot walls which face each other and delimit the respective slot in the circumferential direction; the vane or each of the vanes is in sliding contact with at least one of the slot walls in the assigned slot; the functional region comprises a hollow profile and projections projecting outwards from the hollow profile and into the moulded region; and wherein the functional region consists of a sliding material and the projections form the slot surface, which is in sliding contact with the respective vane, as a sliding surface.

18. The rotary pump according to claim 1, wherein the material composite structure is fixed or movably mounted on another component of the rotary pump in the region of a circumferential surface, and the functional region forms the circumferential surface of the material composite structure.

19. The rotary pump according to claim 1, wherein the rotary pump is a lubricating oil pump for supplying a unit with lubricating oil, or a gas pump for delivering a gas, and/or is designed to be arranged in a motor vehicle and is designed for the delivery rotor to be driven by a drive motor of the vehicle in a fixed rotational speed relationship to the drive motor.

20. The rotary pump according to claim 1, wherein the setting structure can be moved transverse to the rotational axis.

* * * * *